United States Patent [19]

Gruber

[11] Patent Number: 4,970,923

[45] Date of Patent: Nov. 20, 1990

[54] SHAPING DIE

[76] Inventor: Siegfried F. Gruber, 5624 W. School, Chicago, Ill. 60634

[21] Appl. No.: 687,777

[22] Filed: Dec. 31, 1984

Related U.S. Application Data

[63] Continuation-in-part of Ser. No. 367,474, Apr. 12, 1982, abandoned.

[51] Int. Cl.[5] ..... B21D 28/00

[52] U.S. Cl. ..... 83/32; 83/55; 83/690; 409/60; 409/275

[58] Field of Search ..... 409/21, 59, 60, 275, 409/279; 83/50, 55, 688, 689, 690, 32

[56] References Cited

U.S. PATENT DOCUMENTS

| | | | |
|---|---|---|---|
| 880,085 | 2/1908 | Lindsey | 83/690 X |
| 1,613,766 | 1/1927 | Parcher | 83/689 X |
| 3,724,305 | 4/1973 | Kondo | 83/55 X |
| 4,362,078 | 12/1982 | Ohnishi et al. | 83/50 X |

FOREIGN PATENT DOCUMENTS

| | | | |
|---|---|---|---|
| 1032798 | 7/1953 | France | 83/688 |

*Primary Examiner*—Z. R. Bilinsky

*Attorney, Agent, or Firm*—Edmond T. Patnaude

[57] ABSTRACT

A die for use in a punch-press operation has a constant shear angle throughout the entire cutting edge and the surface profile of the die is convex to draw the workpiece away from the cutting edge of the die as the workpiece is being punched out.

6 Claims, 2 Drawing Sheets

SHAPING DIE

The present invention relates in general to the art of metal shaping wherein a metal workpiece is die-cut to a desired shape, and it relates in particular to a new and improved die configuration and to a method of using the novel die.

This is a continuation-in-part application of pending prior application Ser. No. 06/367,474 filed on Apr. 12, 1982, abandoned by Sigfried F. Gruber for a DIE HOBBER.

BACKGROUND OF THE INVENTION

There is a need in various types of machinery for metal parts having external and internal shapes whose dimensions must be held within extremely close tolerances. Moreover, such parts may require that the internal and/or external configuration be perpendicular to the plane of the part. When such parts are manufactured by prior art techniques, such as milling, shaving and hobbing it is both difficult and expensive to maintain close dimensional tolerances and to avoid stressing the material with a consequent distortion of the part. The problem is accentuated where the parts are formed of hard materials, such as tool steel.

By way of example, when using prior art techniques it has been very difficult and costly to manufacture relatively thin gears having the sizes or working surfaces of the gear teeth extending at straight angles, i.e., perpendicular to the planes of the gears. Such gears have been made in the past by shaving the blanks to the desired shapes and subsequently heating and flattening the parts. Not only have the shaved surfaces not always been acceptable but the cost of reworking the shaved parts to restore the required flatness has been excessive except in the case of a few extremely necessary parts.

OBJECTS OF THE INVENTION

The principal object of the present invention is, therefore, to provide a new and improved method and means which enables the economical manufacture of metal parts having sides extending perpendicular to the plane of the workpiece, which methods permits the holding of extremely close tolerances and does not result in stress concentrations which would distort the workpiece.

Another object of the present invention is to provide a novel die configuration for use in the said method, which die configuration may be used for shaping very hard, machineable materials, such as high speed tool steel.

SUMMARY OF THE INVENTION

Briefly, there is provided in accordance with the present invention a novel die configuration which may be used in a metal removal operation which may be carried out in a punch press. In accordance with the novel method of this invention the workpiece is pushed along the cutting edge of the die to remove edge material from the workpiece and thus provide the workpiece with the desired shape.

In a preferred embodiment of the invention the die has a three hundred sixty degree cutting edge wherefor the entire external or internal edge of the workpiece is formed in a single operation. The workpiece is pushed through the die by a pusher member having an edge shape which is complementary to the cutting edge of the die and dimensioned to provide a minimum clearance between the complementary edges of the die and the pusher member.

The die of the present invention has a facial contour on the active side of the die which can be mathematically derived to provide the cutting edge of the die with a substantially constant shear angle throughout its entire length. The optimum shear angle is related to the diameter and hardness of the material being worked and may be chosen on the basis of experience or in some other suitable manner.

The active side of the die is convex and slopes away from the cutting edge so that the material, which is preferably removed in the form of chips, will move freely away from the workpiece as it moves past the cutting edge. In the case, for example, where the external edge of the workpiece is being formed, as the workpiece is pushed through the die the convex contour of the die outwardly stresses or stretches the workpiece as the removed material is cut and pulled radially outward. Where an internal edge is being formed the workpiece is pulled inwardly by the convex working surface of the die. As a result, no stress concentration in the workpiece results, and no distortion of the workpiece occurs. In some cases it has been found that the flatness of the workpiece is actually increased when the sides are shaped in accordance with the present invention.

Other inherent advantages of the method of the present invention as compared to the use of conventional dies and punch press operations are quieter operation and lower maintenance costs. I have found that the dies of the present invention need be sharpened less than one-third as frequently as conventional punch press dies. Moreover, because of the smooth cutting action of the die, the temperature of the workpiece is not raised as much as it would be in a conventional punch press operation.

GENERAL DESCRIPTION OF THE INVENTION

The present invention will be better understood by a reading of the following detailed description taken in connection with the accompanying drawings wherein.

DETAILED DESCRIPTION OF A PREFERRED EMBODIMENT OF THE INVENTION

The present invention may find application wherever it is desired to form a vertical edge on a part, but is particularly suited for cutting vertical side edges on relatively thin, hard metal parts. For example, the invention has been used to cut both internal and exteral involute teeth on thin flat parts such as gears and splines formed of high speed tool steel, and parts having an external diameter of more than nine inches and a thickness of less than one-eighth inch have been made in accordance with the teachings of the present invention. Therefore, although the invention is described herein in connection with the manufacture of a few representative parts, its use is not so limited.

Figure 1:
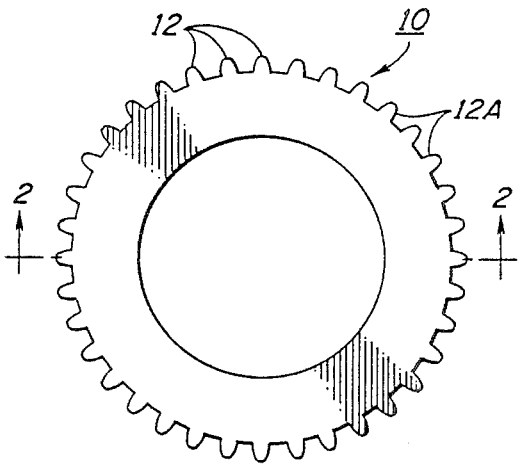
FIG. 1 is a plan view of an external gear which may be made by the method of the present invention.
Figure 3:
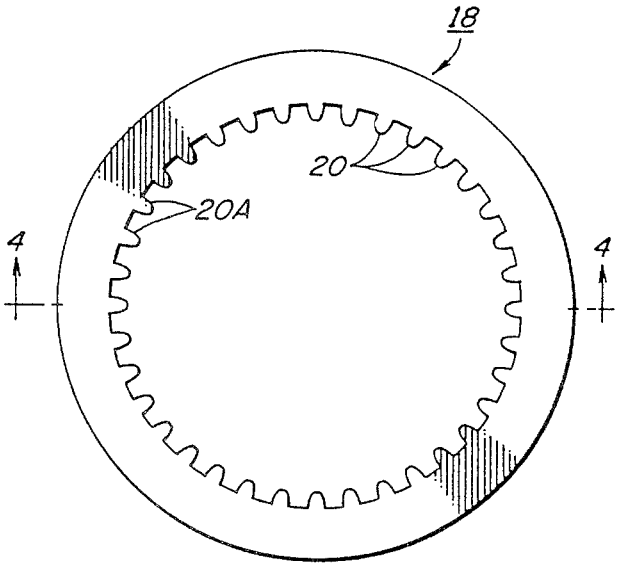
FIG. 3 is a plan view of an internal gear which may be made by the method of the present invention.
Figure 2:
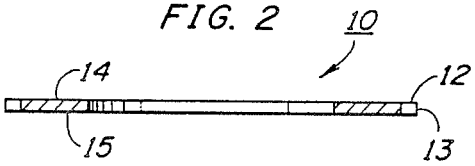
FIG. 2 is a cross-sectional view of the gear of FIG. 1 taken along the line 2—2 thereof.

Referring to FIGS. 1 and 3, there is shown a thin, flat member 10 of generally annular shape having a plurality of external teeth 12. The teeth 12 are identical and equally spaced, and they have sides 12A in the shape of a partial involute. The member 10 may function as an external gear or spline and may be seen from an inspection of FIG. 2 to be relatively thin in cross-section. The continuous external side edge of the member 10 is identified at 13 and may be seen to be perpendicular to the principal plane and faces 14 and 15 of the member 10.

Figure 4:
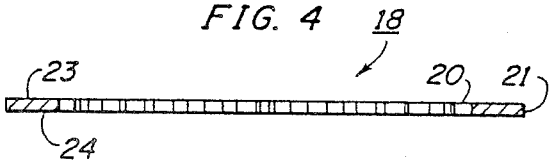
FIG. 4 is a cross-sectional view of the gear of FIG. 3 taken along the line 4—4 thereof.

Referring to FIGS. 3 and 4, there is shown a thin, flat member 18 of generally annular shape having a plurality of equally spaced internal teeth 20 having the sides 20A thereof each in the shape of a partial involute. As best shown in FIG. 4, the internal side edge of the member is identified at 21 and its perpendicular to the principal plane and faces 23 and 24 of the member 18.

Figure 5:
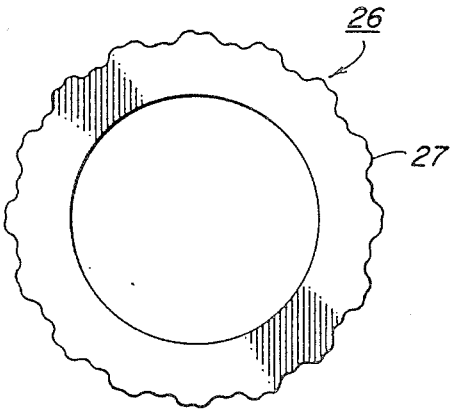
FIG. 5 is a plan view of still another part having a complex peripheral configuration which may be made by the method of the present invention.

Referring to FIG. 5 there is shown a thin flat member 26 having an external perpendicular edge 27 of relatively complex configuration in the plane of the member 26. The external edge 27 may be formed in accordance with the teachings of this invention.

Figure 6:
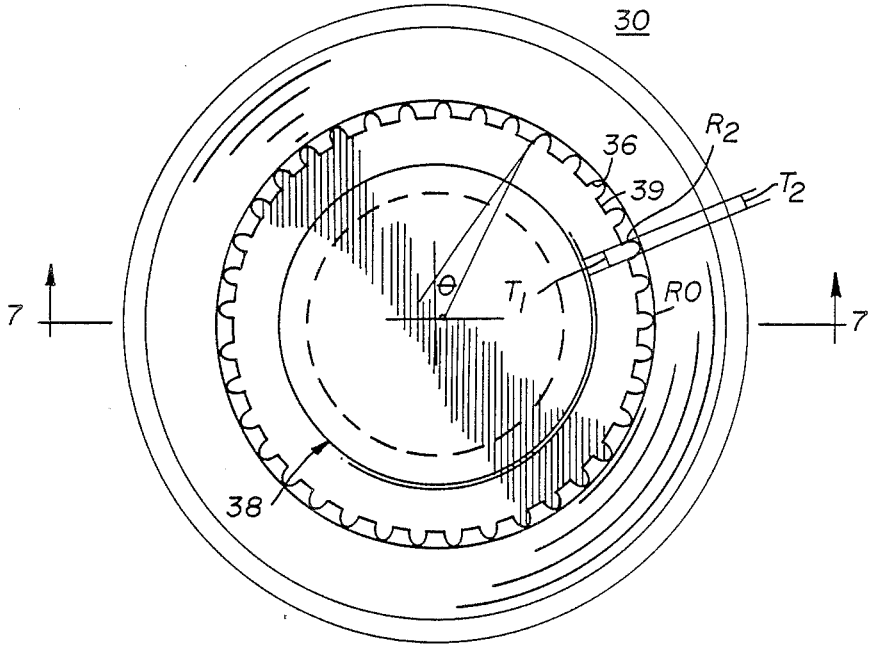
FIG. 6 is a plan view showing the gear of FIG. 1 being made by the method of the present invention.
Figure 7:
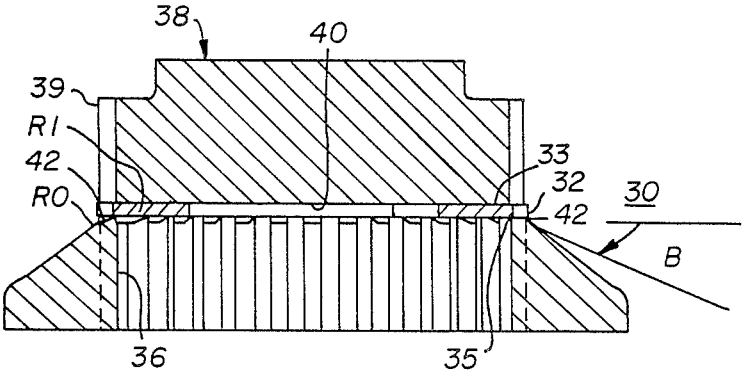
FIG. 7 is a cross-sectional view taken along the line 7—7 of FIG. 6.

Referring now to FIGS. 6 and 7 there is shown a die 30 for removing metal from the external side 32 of a flat metal plate or workpiece 33 as the plate 33 is pushed past the cutting edge 35 of the die through the center opening 36 therein by means of a pusher member 38. The side 39 of the pusher member 38 is complimentary to the cutting edge 35 of the die 30 although a substantial clearance of a few thousandths of an inch or more may be provided between the pusher member and the die. The lower face 40 of the pusher member is complementary to the upper face of the workpiece 33. The die 30 and the pusher member 38 are preferably mounted to the base and upper platen respectively of a conventional punch press whereby the pusher member 38 is driven down toward the die 30 to push the workpiece 33 therethrough as in a conventional punch press operation. Preferably the workpiece 33 is a blank having its outer edge more or less conforming to the external shape of the final part thereby to facilitate removal and disposition of the metal from the workpiece in the form of small chips.

In accordance with an important aspect of the present invention the die 30 has a particular facial contour 42 on the working side of the die, which contour is convex and in association with the vertical side 36, provides a cutting edge 35 having a substantially constant shear angle throughout its entire length. The optimum shear angle will vary with the hardness and thickness of the part being made, but whatever shear angle is selected, it is substantially the same along the entire cutting edge of the die. For example, for most applications where high speed tool steel is to be worked, a shear angle between six degrees and fifteen degrees will generally be used. The facial contour of the die can, as more fully described hereinafter, be mathematically computed when the planar shape of the part to be formed is given mathematically, and the computation necessary for developing this facial contour can best be made using a general purpose computer. However, since the facial contour 42 is uniform for all radii of the die the contour can be shaped in any precise metal working process such as turning or milling.

The working contour of the die 30 extends from the innermost portions of the edge 35, identified in FIG. 7 as $R_I$, to a location a short distance outward of the maximum external radius of the cutting edge 35. The reference character $R_O$ indicates the latter location or radius. The upper face of the die between the locations $R_I$ and $R_O$ has a cross-sectional profile which may be seen to be convex and in combination with the involute tooth configuration shown in FIG. 6 provides the cutting edge 35 with a constant shear angle throughout its entire 360 degree length. The shape of the contour between the radii $R_I$ and $R_O$ can be mathematically computed as described hereinafter.

The portion of the die which is exterior to the radius does not have a critical facial contour, but is preferably slopes downwardly so that the removed chips will fall by gravity away from the workpiece and away from the die itself.

Figure 8:
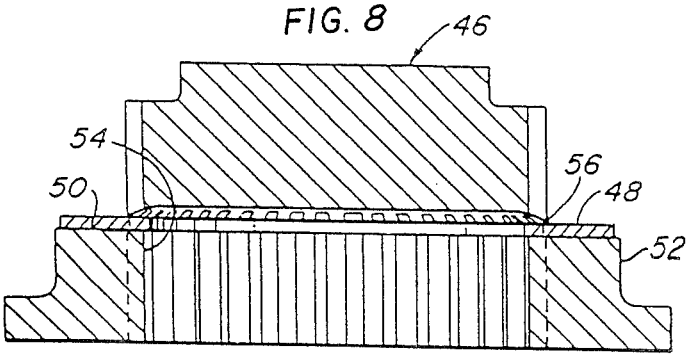
FIG. 8 is a cross-sectional view similar to that of FIG. 7 but showing the gear of FIG. 3 being made by the method of the present invention.

Referring to FIG. 8 there is shown a novel die 46 for cutting the internal edge of the part 18 shown in FIGS. 3 and 4. In FIG. 8, a blank 48 rests on the upper face 50 of an annular support piece 52 adapted to rest on the base platen of a punch press. The support piece 52 has an internal vertical wall 54 which is similar in horizontal cross-section to the internal edge of the part to be formed. The lower face of the die 46 is the working face thereof and is contoured to provide a cutting edge 56 having a constant-.shear angle throughout its entire 360 degree length. The edge 56 lies in a horizontal plane and corresponds to the internal edge of the part 18 as shown in FIG. 3.

When forming the internal edge of a part in accordance with this aspect of the invention, a flat, annular blank 48 is placed on the pusher member 52 in a punch press and the die 46 is fixedly mounted to the upper platen. The press is then operated to push the die 46 into the central opening in the support member 52 thereby to cut the metal from the interior edge of the blank 48 to precisely form the internal edge of the finished part. The metal is removed in the form of chips and falls by gravity into the central opening in the support member 52.

The optimum speed at which the die is moved past the workpiece during the cutting operation will vary with the hardness and thickness of the workpiece, but I have produced acceptable parts at the rate of thirty-five per minute.

Figure 9:
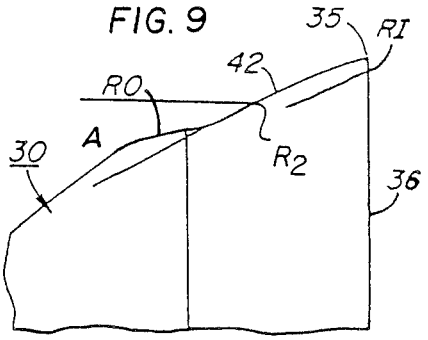
FIG. 9 is a fragmentary, sectional view of a portion of a die embodying the present invention.

With reference to FIG. 9, the facial contour of the working area of the die for cutting radial teeth of an involute configuration may be computed using the following formula:

$$A = \text{Arc Tan}\frac{\text{Tan } B}{\sqrt{1-\left(\frac{R_1\text{Cos}\phi_1}{R_2}\right)^2+\left(\frac{T_1}{2R_1}+INV\phi_1-INV\phi_2\right)}}$$

wherein:

A = angle of contour at radius $R_2$ relative to the horizontal

B=shear angle of cutting edge relative to the horizontal $R_1$=pitch radius $R_2$=radius at each point on the die $T_1$=arc thickness of tooth at $R_1$ $INV\emptyset = \tan \emptyset_1 - \emptyset_1\pi/180$ $INV\emptyset = \tan \emptyset_2 - \emptyset_2\pi/180$ $\emptyset_1$=pressure angle at $R_1$ $\emptyset_2$=pressure angle at $R_2$ This equation can best be solved for a plurality of incremental values $R_2$ by means of a digital computer. The angular values A can be plotted in the associated computer printer to provide the plot shown in FIG. 9, which contour is a radial section taken at all circumferential points of the die. It will be apparent that for the parts 10 and 18 the contour profile is the same even though one die is for cutting radial involute teeth on the external edge of the workpiece and the other die is for cutting identical involute teeth in the internal edge of the workpiece.

It will be understood that other equations may be used for determining the convex contours necessary for providing constant shear angles for cutting edges of other shapes such, for example, as those shaped to form a complex configuration such as the external profile of the part 26 shown in FIG. 5 or of square teeth (not shown) or of any other configuration.

While the present invention has been described in connection with particular embodiments thereof, it will be understood by those skilled in the art that many changes and modifications may be made without departing from the true spirit and scope of the present invention. Therefore, it is intended by the appended claims to cover all such changes modifications which come within the true spirit and scope of this invention.

What is claimed:

1. A method of providing a continuous side edge on a thin plate, said side edge being perpendicular to the plane of said plate, comprising the steps of providing a plate having a continuous edge generally conforming to said continuous side edge, providing a die having a cutting edge corresponding to said continuous side edge and a facial contour sloping away from said cutting edge, said facial contour being convex and configured to provide a substantially constant shear angle along said entire cutting edge, positioning said plate against said die with said continuous edge being in proximity with said cutting edge, positioning a rigid pusher member having an edge complimentary to the shape of said cutting edge against the side of said plate opposite said die and pushing said pusher member and said plate past said cutting edge of said die to remove material from said continuous edge of said plate to form said continuous side edge thereon.

2. A method according to claim 1 wherein said continuous edge is on the exterior edge of said plate, and said cutting edge is on on interior edge of said die.

3. A method according to claim 1 wherein said shear angle and said facial contour cause said cutting edge to remove material from said continuous edge in the form of chips.

4. A method according to claim 1 wherein said continuous edge is a plurality of involute teeth and the cross-sectional configuration of said facial contour is defined by the following equation:

$$A = \text{Arc Tan} \frac{\text{Tan } B}{\sqrt{1 - \left(\frac{R_1 \text{Cos}\emptyset_1}{R_2}\right)^2 + \left(\frac{T_1}{2R_1} + INV\emptyset_1 - INV\emptyset_2\right)}}$$

wherein:

A=angle of contour at radius $R_2$ relative to the horizontal

B=shear angle of cutting edge relative to the horizontal $R_1$=pitch radius $R_2$=radius at each point on the die $T_1$=arc thickness of tooth at $R_1$ $INV\emptyset = \tan \emptyset_1 - \emptyset_1\pi/180$ $INV\emptyset = \tan \emptyset_2 - \emptyset_2\pi/180$ $\emptyset_1$=pressure angle at $R_1$ $\emptyset_2$=pressure angle at $R_2$

5. A die for removing metal from a metallic workpiece, said die having a continuous cutting edge having a shear angle within the range of six degrees to fifteen degrees throughout the entire length of said cutting edge.

6. A die for removing metal from a metallic workpiece, said die having a cutting edge in the form of an involute in cross section and having a facial contour substantially defined by the following equation:

$$A = \text{Arc Tan} \frac{\text{Tan } B}{\sqrt{1 - \left(\frac{R_1 \text{Cos}\emptyset_1}{R_2}\right)^2 + \left(\frac{T_1}{2R_1} + INV\emptyset_1 - INV\emptyset_2\right)}}$$

wherein:

A=angle of contour at radius $R_2$ relative to the horizontal

B=shear angle of cutting edge relative to the horizontal $R_1$=pitch radius $R_2$=radius at each point on the die $T_1$=arc thickness of tooth at $R_1$ $INV\emptyset = \tan \emptyset_1 - \emptyset_1\pi/180$ $INV\emptyset = \tan \emptyset_2 - \emptyset_2\pi/180$ $\emptyset_1$=pressure angle at $R_1$ $\emptyset_2$=pressure angle at $R_2$

* * * * *